United States Patent [19]

Rashid

[11] 4,129,461

[45] Dec. 12, 1978

[54] FORMABLE HIGH STRENGTH LOW ALLOY STEEL

[75] Inventor: Moinuddin S. Rashid, Rochester, Mich.

[73] Assignee: General Motors Corporation, Detroit, Mich.

[21] Appl. No.: 785,339

[22] Filed: Apr. 7, 1977

Related U.S. Application Data

[63] Continuation-in-part of Ser. No. 642,457, Dec. 19, 1975, abandoned.

[51] Int. Cl.[2] ..... C21D 7/00

[52] U.S. Cl. ..... 148/12.3; 148/12 F

[58] Field of Search ..... 148/12.3, 12 F

[56] References Cited

U.S. PATENT DOCUMENTS

| | | | |
|---|---|---|---|
| 3,330,705 | 7/1967 | Madrzyk et al. | 148/12 F |
| 3,928,086 | 12/1975 | Bailey | 148/12.3 |
| 3,930,907 | 1/1976 | Bailey | 148/12.3 |

FOREIGN PATENT DOCUMENTS

| | | | |
|---|---|---|---|
| 2187922 | 1/1974 | France | 148/12 F |

*Primary Examiner*—Arthur J. Steiner
*Attorney, Agent, or Firm*—George A. Grove

[57] ABSTRACT

The formability of high strength low alloy steel is improved while strength is substantially maintained or improved by first heating the steel to at least the lowermost eutectoid temperature of the steel to dissolve a substantial proportion of the carbides and nitrides (if nitrides are present) into the austenite and air cooling to substantially lower the yield strength and improve formability without significantly reducing tensile strength. The steel is then deformed to an amount equivalent to at least 2% strain on the tensile stress-strain diagram whereby the yield strength is substantially recovered. Preferably, the steel is then heat aged whereby the yield strength and tensile strength are each further raised.

10 Claims, 10 Drawing Figures

FORMABLE HIGH STRENGTH LOW ALLOY STEEL

This is a continuation-in-part of my copending application Ser. No. 642,457, filed Dec. 19, 1975, now abandoned.

BACKGROUND OF THE INVENTION

This invention relates to a method for treating high strength low alloy steel whereby a material having markedly improved formability is provided which after forming and aging has a yield strength and tensile strength substantially equal to or higher than the original values.

Plain carbon steel having a yield strength of 30 to 40 ksi was used extensively in early automobiles and is presently the most commonly used automotive structural material. However, in recent years the need to satisfy safety and emission requirements resulted in progressively increased vehicle weight. At the present time there is an urgent need to conserve materials and energy. Structural vehicle material may be conserved and vehicle weight reduced by developing and using structural materials having a higher strength to weight ratio. One of the more promising potential substitute materials for the low carbon steel is the family of high strength low alloy (HSLA) steels, SAE 950X and SAE 980X, which have yield strengths in the range of 50 and 80 ksi, respectively. These are relatively new steels and have a chemistry which is similar to that of the plain carbon steel. Their superior strength is achieved by a controlled hot rolling schedule and a rapid controlled cooling which produces a very small ferrite grain size. Further, by minor additions of suitable alloying elements such as vanadium, niobium or titanium, which are good carbide and nitride formers, additional strength is achieved by the mechanism of precipitation hardening and solid solution strengthening. To insure isotropic properties, small quantities of rare earth elements or zirconium are added to control the shape of sulfide inclusions; small globular sulfides are prevented from elongating into stringers during hot rolling.

The HSLA steels have high strength, fair ductility, some directionality and, because of a low carbon equivalent, good weldability, but their formability is inferior to that of hot rolled plain carbon steels for all methods of sheet metal forming. The poor formability of the SAE 980X steels, for example, is one of the principal reasons for their limited use in automotive applications. To the extent that these steels are useable, their higher strength can result in excessive wear of tools and dies.

SUMMARY OF THE INVENTION

This invention is concerned basically with a method which is operative to reduce the yield strength and improve formability of HSLA steel without reducing the tensile strength to enable the metal to be more readily formed without degrading the existing mechanical properties. In general, the method comprises first heating the HSLA steel to at least its lowest eutectoid temperature, preferably to a temperature in its ($\alpha + \gamma$) region, for a time sufficient to dissolve a substantial proportion of the iron carbides and the carbides and nitrides of the alloying constituents into the austenite and then cooling the metal to produce a microstructure such that the yield strength is reduced and formability is markedly improved. A typical suitable microstructure comprises ferrite, 10% to 20% by volume martensite, and redistributed alloy carbides and nitrides.

Next, the metal is plastically deformed as required by the intended forming operation by which the parts are to be stamped or otherwise formed. The amount of the deformation must be equivalent to at least 2% strain on the tensile stress-strain diagram to work-harden the metal and to thereby substantially increase its yield strength. Preferably, the deformed part is heated to a temperature and for a time sufficient to further increase the yield strength and tensile strength close to or above their original values, for example, to about 400° F. for about 10 to 15 minutes.

DESCRIPTION OF THE PREFERRED EMBODIMENTS

As previously indicated, this invention is concerned with improving the formability of HSLA steels so that they are comparable as to formability to the plain carbon steels presently used without imparing their superior strength properties so that the material may be used in substantially thinner gauges with substantial saving in the material and with substantial weight reduction.

Figure 1:
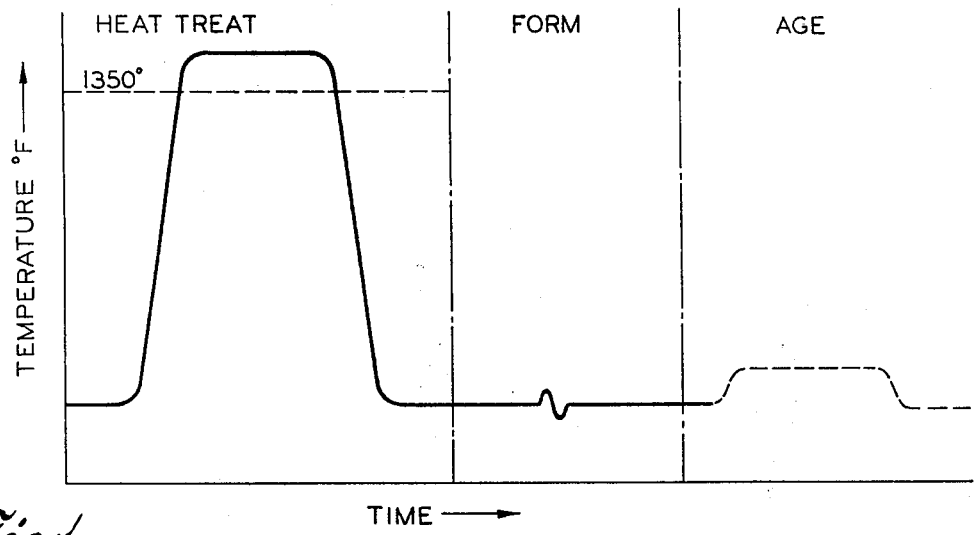
FIG. 1 is a time-temperature curve generally depicting the three steps of the invention.

The method of the invention is generally illustrated in FIG. 1 as consisting in essentially three basic steps:

(1) A heat treatment prior to forming which involves heating the steel to at least its lowermost eutectoid temperature and cooling it to about room temperature. The steel is heated at a temperature or temperatures for a time and then cooled at a rate or rates so as to reduce the yield strength to about 55 ksi or less (for SAE 980X steel), sufficient to render the steel satisfactorily formable without reducing the tensile strength. Air cooling is usually satisfactory. Other modes of cooling that produce the desired reduction in yield strength may be used.

(2) A prestrain step in which the steel is plastically deformed as by stamping to a strain level of at least about 2% strain on the tensile stress-strain diagram whereby the metal is formed to a desired configuration and the yield strength is raised.

(3) Preferably a heat aging step, for example at about 400° F. for 10 to 60 minutes, whereby both the yield strength and tensile strength are further raised clear to or above their original values.

A detailed example in terms of experimental work performed in the preferred embodiment showing the effectivenss of the method follows.

An SAE 980X hot rolled steel, identified as Van 80, was obtained as a sheet 0.079 inch thick and 15 inches × 30 inches in area from Jones and Laughlin Steel Company, having a composition of 0.12% C, 0.001% Ti, 0.11% V, less than 0.002% Nb, 0.008% Mo, 1.46% Mn, 0.019% N, 0.002% O, 0.15% misch metal, and balance iron. The V is the principal strengthening alloy addition or precipitate forming alloy constituent referred to previously in the steel. The microstructure of such a steel as received is illustrated in FIGS. *6a–6c*.

FIG. *6a*, a scanning electron micrograph at 5000 fold magnification, shows a matrix of small grained (usually ASTM 11–13) ferrite 10 with cementite particles 12 situated mainly at grain boundaries. In addition, a fine distribution of the strengthening vanadium carbonitride (VCN) precipitates 14 are faintly observed.

FIG. *6b*, a scanning electron micrograph at 2000 fold magnification, shows the ferrite matrix 10 seen in FIG. *6a* plus pearlite 16 and decomposing pearlite 18.

FIG. *6c*, a transmission electron micrograph of the as-received HSLA steel at 60,000X shows a high density of strengthening vanadium carbonitride (VCN) precipitates 14.

Standard (ASTM-E8) size tensile specimens were machined from the as-received steel sheet in a direction parallel to the rolling direction.

Some of the specimens were heated to a temperature ranging from 1350° F. to 1600° F. in 50° increments. This was accomplished by immersing the specimens for 5 minutes in a $BaCl_2$-NaCl neutral salt bath heated to such temperatures. All specimens were air cooled.

Tensile tests were then conducted on both the heat treated and as-received test bars at room temperature on a Wiedmann-Baldwin testing machine at a crosshead speed of 0.2 inch per minute. The strain was measured with a Satec dual range extensometer over a 3 inch gauge length.

Figure 2:
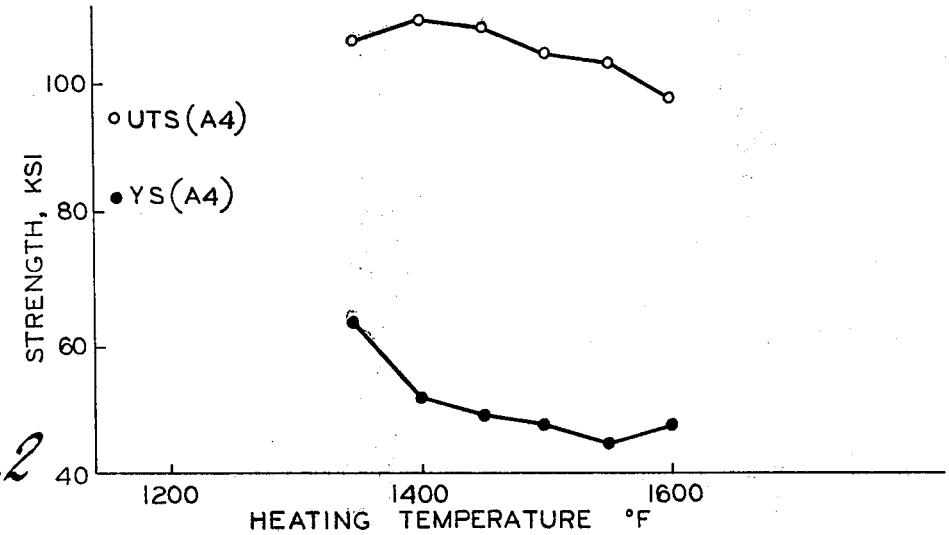
FIG. 2 is a plot showing the effect of the heat treatments on the yield and tensile strength of HSLA steel.

The yield strengths of these specimens were plotted against the treatment temperature as shown in FIG. 2. It is noted that the yield strength decreased from about 80 ksi in the as-received material to less than 50 ksi in the heat treated material heated to a temperature of 1400° F. or more. It was also noted that the tensile strength remained constant at values greater than 100 ksi.

Other such specimens were immersed in a $BaCl_2$-NaCl neutral salt solution and heated at 1450° F. for 3 minutes. The specimens were then removed from the salt bath and hung in air at room temperature to cool. After cooling, the specimens were washed in water to remove the salt and tensile tested as described above.

Figure 3:
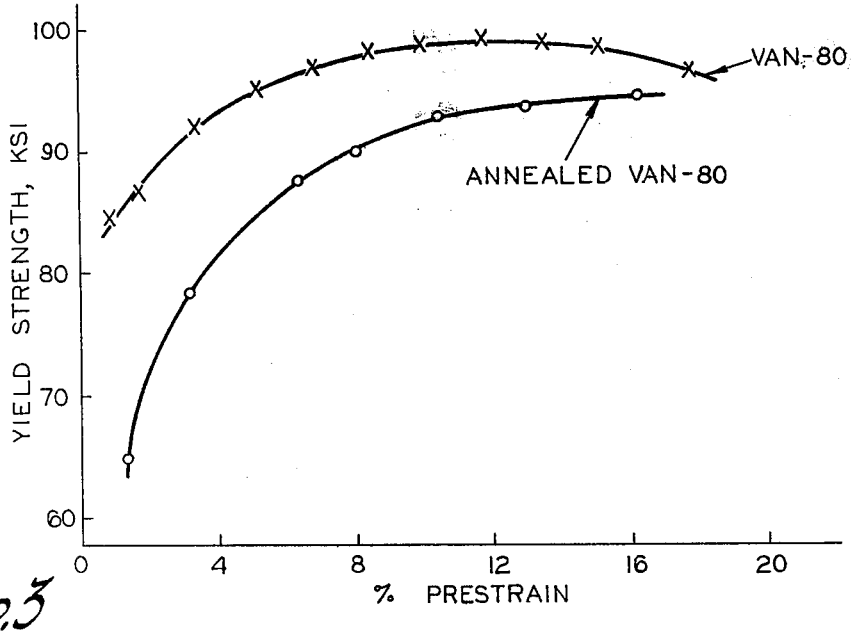
FIG. 3 is a yield strength-prestrain curve comparing the as-received HSLA steel with the same steel after the heat treatment of this invention.

FIG. 3 is a plot showing the variation of yield strength as a function of prestrain. As observed previously in FIG. 2, the yield strength is markedly reduced as a result of the heat treatment. However, the steel work hardens at a rapid rate as is apparent from FIG. 3. For example, at a prestrain level of 2%, the yield strength of the heat treated steel is 75 ksi and at a prestrain level of 8% the yield strength is about 90 ksi.

Figure 4:
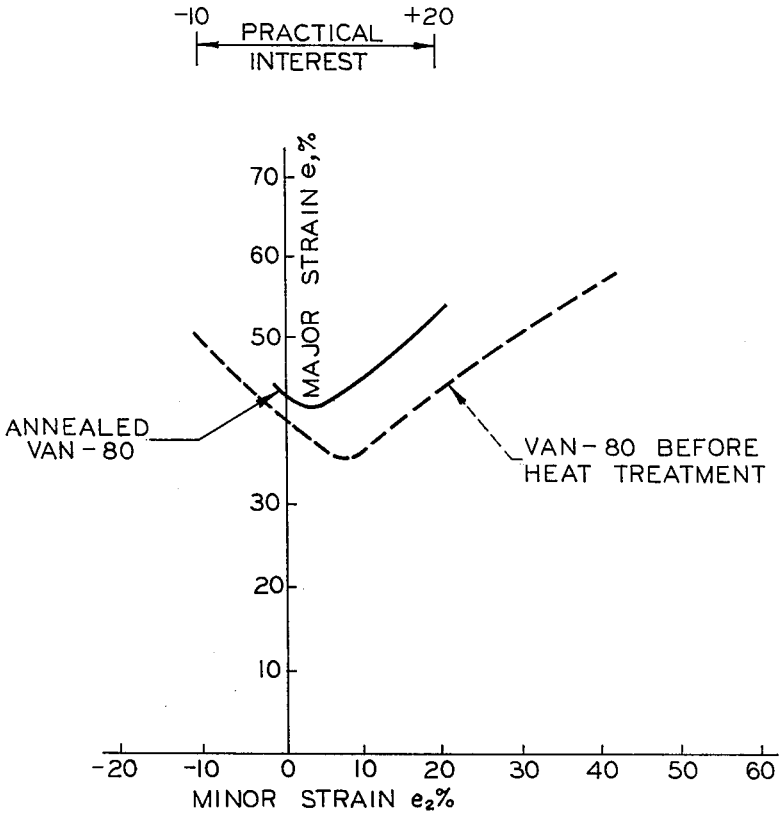
FIG. 4 is a formability limit plot comparing the formability of an as-received HSLA steel with the same steel after the heat treatment of this invention.

The formability of the heat treated material was determined and compared with the as-received material by the following procedure. Seven and one-half inch square samples of each material were prepared. Contiguous circles, 0.100 inch in diameter, were photoetched over the entire area of each sample. Each sheet was then placed over a female die cavity with the etched surfaces facing the cavity and a four inch diameter dome-shaped punch was slowly forced against the sheet thereby stretching it until a crack appeared in the stretched sheet at the point of greatest strain. Different sheets were deformed with different degrees of lubrication to achieve different degrees of stretch before cracking occurred. Some of the circles were predominantly enlarged and others were elongated into an elliptic configuration. Circles were then selected which had been stretched to a maximum extent without cracking. Strain values $e_1$ and $e_2$ were calculated from the major and minor axes of each ellipse. These were then plotted as shown in FIG. 4 with the major axis strain as the ordinate and the minor axis strain as the abscissa. The area below each of the curves represents a biaxial combination of strain to which the metal sheet can be stretched without cracking and a biaxial combination of strain above the curve are those to which the metal cannot be stretched without cracking. These curves are known as forming limit curves. The higher the curves, the better the formability of the steel. It is to be noted that the heat treatment has markedly improved formability. The above test is widely used in the automotive industry and is described in an article by S. S. Hecker, *Met. Engr. Quart.*, 1973, vol. 13, pp. 42–48.

Figure 5:
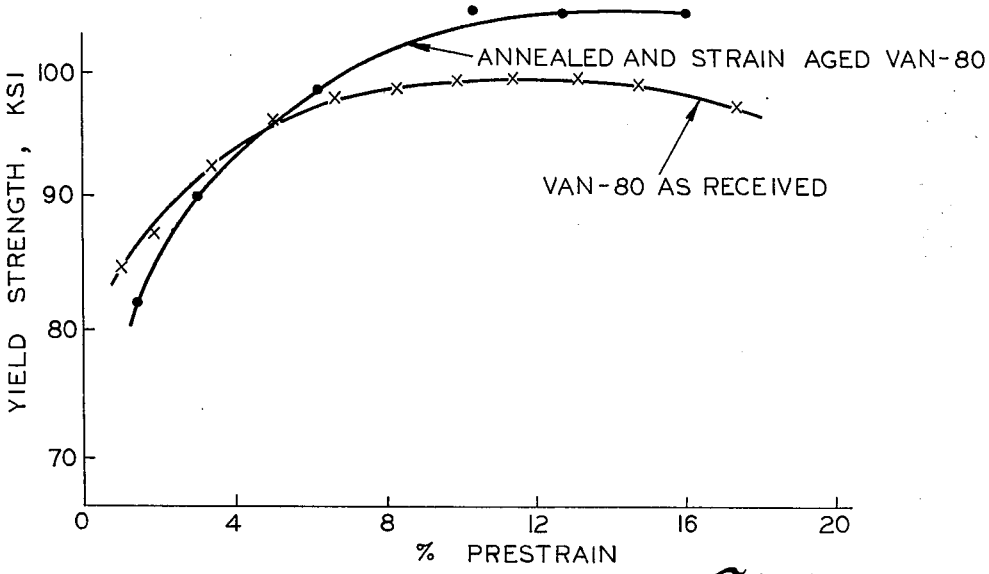
FIG. 5 is a yield strength-prestrain curve comparing the heat treated HSLA steel after deformation and aging with the same steel as received.

Next the strain aging characteristics of the best treated and as-received steels were determined using test specimens described previously. At least eight specimens of each steel were prestrained. Several specimens were prestrained, various amounts then aged at 400° F. for 1 hour in a muffle furnace with no protective atmosphere and air cooled to room temperature. The strain aged specimens were then tension tested to failure in the same direction that they had been prestrained. FIG. 5 shows the yield strength plotted against prestrain values for the heat treated and strain aged steel. This data is compared in FIG. 5 with the as-received steel. It is noted that the steel prestrained over about 4% and aged has a yield strength which is markedly greater than the as-received steel. For example, at a prestrain value of 2%, the heat treated and strain aged steel has a yield strength of 85 ksi and a yield strength of about 97 ksi for prestrain of 8%.

Similar strain aging tests were performed on other SAE 980X and 950X steels including Ultra Form 80 and Ultra Form 50 made by Bethlehem Steel, Maxi Form 80 and Maxi Form 50 made by Republic Steel, and Van 50 made by Jones and Laughlin Steel with similar increases in strength.

In general, it is of course known that annealing softens steels and improves formability but the improvement observed in the steels as indicated by the above tests of the SAE 980X steel was much larger than expected from strength considerations since in all cases a considerable difference was observed between the yield and tensile strength accompanied by an increase in total elongation or ductility. The tests indicated that the annealing temperature is not critical provided that it is above the lowermost eutectoid temperature of the steel. Since temperature variations did not have an appreciable effect on yield strength such an anneal may readily be performed under steel mill production control conditions.

The yield strength lost by the anneal was found to be recoverable, as indicated by the work summarized in FIGS. 3 and 5, some by work hardening in consequence of the deformation involved in the forming operation and some by the subsequent heat aging. In some steels the yield strength was not completely recovered evidently due to the nature of the alloying additions to the steel but substantially so. As previously mentioned, the strength in HSLA steels is developed by minor additions of carbide and nitride formers and a controlled thermomechemical process. In the Van 80, above, the alloying addition is V. In others it is Ti or Nb. The difference in response to work hardening and strain aging appears to result from the difference in the nature, as for example the stability at high temperatures, of the carbides and nitrides of the alloying elements.

Figure 6A:
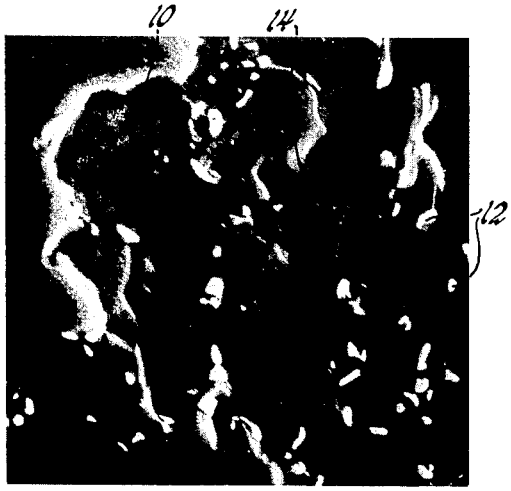
FIG. 6*a* is a scanning electron micrograph at 5000× of an as-received vanadium strengthened SAE 980X steel.
Figure 6B:
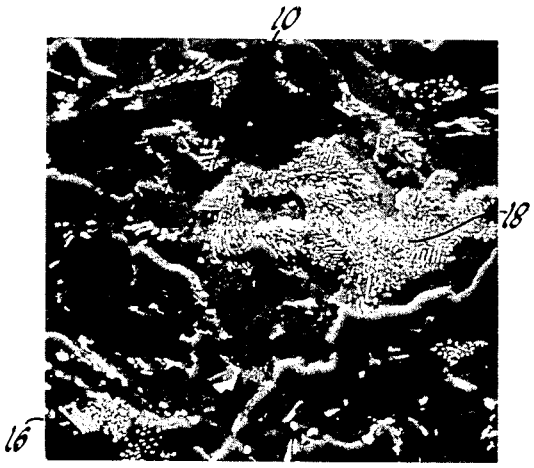
FIG. 6*b* is a scanning electron micrograph at 2000× of an as-received vanadium strengthened SAE 980X steel.
Figure 6C:
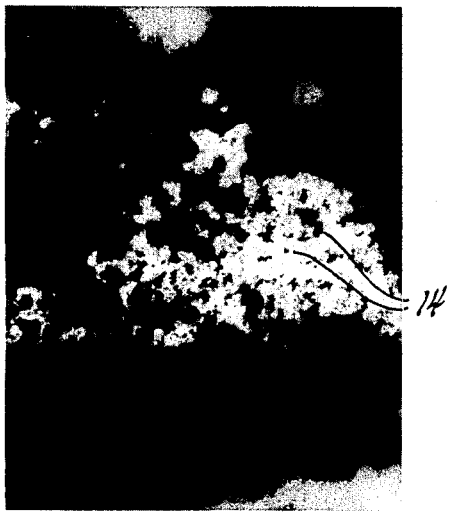
FIG. 6*c* is a transmission electron micrograph at 60,000× of an as-received vanadium strengthened SAE 980X steel.
Figure 7A:
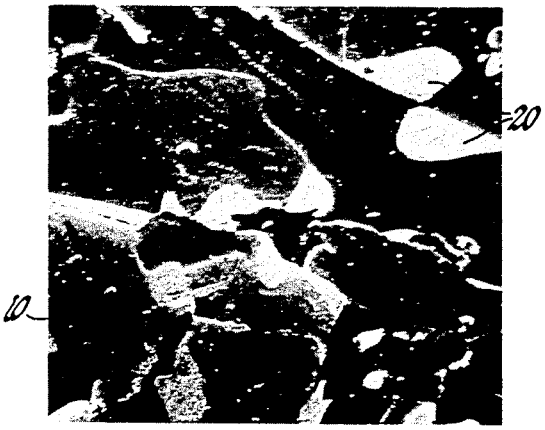
FIG. 7*a* is a scanning electron micrograph at 5000× of a vanadium strengthened steel heat treated in accordance with this invention.
Figure 7B:
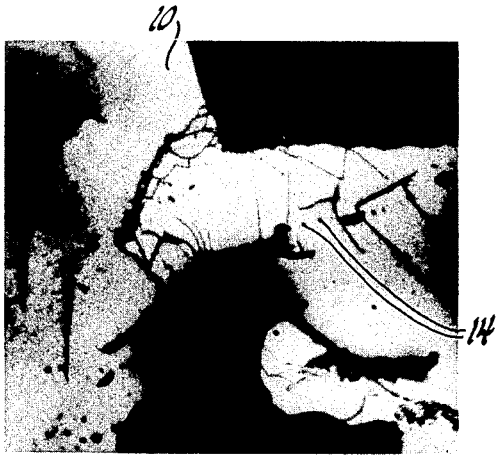
FIG. 7*b* is a transmission electron micrograph at 25,000× of a vanadium strengthened steel heat treated in accordance with this invention.

On heating the Van 80 metal at temperatures above 1350° F., the ferrite surrounding the iron carbides absorbs the carbides and transforms to austenite. Since in the presence of vanadium the solubility of nitrogen in austenite is much higher than it is in ferrite, some dissolution of vanadium carbonitride occurs in the islands of austenite. The extent of this dissolution and of the ferrite to austenite transformation depends on the annealing time and temperature. FIGS. 7*a* and 7*b* depict the microstructure of the steel after it was heated in a neutral salt pot at 1450° F. for 3 minutes and then air cooled to room temperature. After cooling, a portion of the austenite transforms to what has been presently identified as martensite, as indicated at 20 in FIG. 7*a*. At this time it appears that for best mechanical properties 10% to 20% by volume martensite 20 in the microstructure is preferred. Ferrite 10 is present. In FIG. 7*b* it is seen that the density of strengthening precipitates appears to be substantially reduced. (Compare with FIG. 6*c*.) The precipitates have dissolved and either remain in solid solution, or they have reprecipitated on cooling to room temperature and are present in the ferrite in a size too small to be observed at this magnification, the latter being more likely.

Thus, the steel product of the heat treating or annealing portion of my process, as carried out in the above examples, had the following microconstituents: transformed ferrite, untransformed ferrite, martensite, redistributed VCN and substitutional strengthening elements. As shown in the experiments described above, these constituents combined to give a high strength low alloy steel having a low yield strength, good formability, no yield point elongation and a continuous stress-strain curve, a high work hardening rate and tensile strength, and a large total elongation.

On deforming the heat treated steel, the dislocations multiply and interact with one another forming high energy sites in the ferrite. The fine precipitate or other phase distributed in the matrix also retards dislocation motion. In addition, interstitial clustering or strain induced precipitation of the carbonitrides may occur on these sites with a minimum free energy change thereby further retarding dislocation motion. Slip then is believed to occur elsewhere and the process is repeated causing the strain hardening rate of the steel to be increased so that strain is distributed more uniformly and formability is improved.

The essential requirements of the process of the invention in order to obtain its objectives of improved formability and the high strength in the formed component are as follows:

(1) The initial heat treating or annealing temperature should be high enough and for a time to at least partially transform the ferrite to austenite and to dissolve the strengthening precipitates such as the vanadium, niobium or titanium carbides, nitrides, or carbonitrides in the austenite, but not so high or for so long that appreciable ferrite grain growth results. This requires that the steel be heated to at least the lowermost eutectoid temperature of 1350° F. The steel should be cooled at a rate so as to substantially lower yield strength and improve formability while maintaining the tensile strength. To accomplish this the steel is preferably cooled so as to obtain a microstructure containing about 10% to 20% by volume martensite. This can be obtained by annealing suitable chemistries in the $(\alpha + \gamma)$ or $\gamma$ regions and then cooling to room temperature. However, an advantage of annealing in the $(\alpha + \gamma)$ region is that only a portion of the ferrite $(\alpha)$ transforms to austenite $(\gamma)$, the exact fraction being determined by the annealing temperature and only a fraction of the austenite will transform to martensite on cooling to room temperature. On heating into the $\gamma$ region, all ferrite could transform to austenite and controlling the volume fraction of martensite could become more critical.

(2) The minimal 2% deformation referred to above during the forming of the part.

(3) Aging by heating the parts for about 5 minutes at 400° F. or for a longer period at lower temperatures above room temperature as necessary to develop the final desired yield strength. The aging step is not, as a practical matter, effective at room temperature. Tests have shown that the aging equivalent to a treatment of 400° F. for 5 minutes can be obtained by heating at 300° F. for 5 hours or at 270° F. for 1 day. Since most of the strength recovery occurs in consequence of the deformation step in some instances the heat aging step may be omitted.

The method of this invention is ideally suited to current production techniques. The heat treating step may readily be performed at the steel mill on a continuous annealing line. Formability does not deteriorate with the passage of time. Tests were made simulating a steel mill's production line conditions with satisfactory results. The forming step on a component part production basis is performed by placing the sheet metal in a stamping die and straining the sheet equivalent to at least 2% strain on the tensile stress-strain diagram which is the level of deformation involved in the stamping of most automotive component parts. Automobile bumper reinforcements were stamped from heat treated HSLA 980X steel, as described above, on production stamping dies and aged with the same results. Finally, the aging step may be performed without additional treatment during the paint bake cycle used in painting cars.

The foregoing description is based on research and development work performed on hot rolled SAE 980 HSLA steel. Further development work was performed in which some specimens of 0.121 inch hot rolled SAE 980X (Van 80) were first cold rolled to a thickness of 0.076 inch and others to 0.039 inch in the original direction of rolling. The process described above was performed on each set of specimens with results equal to or superior to the results obtained on the hot rolled stock described above.

At present, if an HSLA steel is required in gauges smaller than 0.079 inch it is necessary to cold roll the steel to the desired gauge. The cold rolled steel is then box annealed. The resultant product has a tensile strength of only 60 to 70 ksi and a yield strength of only 50 to 60 ksi as compared with a hot rolled SAE 980 steel. In contrast, the application of the heat treatment of this invention to a cold rolled SAE 980X steel produces a small gauge product having good formability and high tensile strength. Furthermore, after the deformation step on such treated cold rolled steel, during the forming of the part its yield strength is raised to about 80 ksi. Thus the method of this invention may also be used to provide cold rolled gauge steel with markedly superior formability approaching that of plain carbon steel of a thickness of about 0.025 inch.

It is to be appreciated that although the invention has been specifically described in terms of the SAE 980X steels, those skilled in the art will readily apply these teachings to other HSLA steels.

What is claimed is:

1. The method of producing a high strength low alloy steel having improved formability comprising the steps of:

heating a high strength low alloy steel having alloy constituents taken from the group consisting of the carbides, nitrides and carbonitrides of the metals taken from the group consisting of V, Ti, and Nb to at least the lowermost eutectoid temperature of said steel for a time sufficient to at least partially transform the microstructure of said steel to austenite and to dissolve a substantial proportion of said constituents into the austenite without appreciable grain growth and then cooling said steel to substantially room temperatures so as to substantially lower the yield strength and improve the formability of said steel while maintaining the tensile strength thereof; and plastically deforming said steel an amount equivalent to at least 2% strain on the tensile stress-strain diagram to effect a substantial increase in the yield strength after said deformation.

2. The method of producing a high strength low alloy steel having improved formability comprising the steps of:

heating a high strength low alloy steel having alloy constituents taken from the group consisting of the carbides, nitrides and carbonitrides of the metals taken from the group consisting of V, Ti, and Nb to at least the lowermost eutectoid temperature of said steel for a time sufficient to at least partially transform the microstructure of said steel from ferrite to austenite and to dissolve a substantial proportion of said constituents into the austenite without appreciable ferrite grain growth and then cooling said steel to substantially room temperatures so as to substantially lower the yield strength and improve the formability of said steel while maintaining the tensile strength thereof;

plastically deforming said steel an amount equivalent to at least 2% strain on the tensile stress-strain diagram to effect a substantial increase in the yield strength after said deformation, and heating said deformed steel to a temperature and for a time sufficient to increase the yield strength to a value in the vicinity of its original value.

3. The method of producing a high strength low alloy steel having improved formability comprising the steps of:

heating a high strength low alloy steel having alloy constituents taken from the group consisting of the carbide, nitride and carbonitride of vanadium to the lowermost eutectoid temperature of said steel for a time sufficient to at least partially transform the microstructure of said steel from ferrite to austenite and to dissolve a substantial proportion of said constituents into the austenite without appreciable ferrite grain growth and then air cooling said steel to substantially room temperature so as to reduce the yield strength to about 55 ksi or less and improve formability of said steel while maintaining the tensile strength thereof;

plastically deforming said steel an amount equivalent to at least 2% on the tensile stress-strain diagram to effect a substantial increase in the yield strength after said deformation.

4. The method of producing a high strength low alloy steel having improved formability comprising the steps of:

heating a high strength low alloy steel having alloy constituents taken from the group consisting of the carbide, nitride and carbonitride of vanadium to the lowermost eutectoid temperature of said steel for a time sufficient to at least partially transform the microstructure of said steel from ferrite to austenite and to dissolve a substantial proportion of said constituents into the austenite without appreciable ferrite grain growth and then air cooling said steel to substantially room temperature so as to reduce the yield strength to about 55 ksi or less and improve formability of said steel while maintaining the tensile strength thereof;

plastically deforming said steel an amount equivalent to at least 2% on the tensile stress-strain diagram to effect a substantial increase in the yield strength after said deformation, and heating said deformed steel to a temperature and for a time sufficient to increase the yield strength and tensile strength to values greater than their original values.

5. The method of producing a high strength low alloy steel having improved formability comprising the steps of:

heating a high strength low alloy steel having alloy constituents taken from the group consisting of the carbide, nitride and carbonitride of vanadium to a temperature above 1350° F. for a time sufficient to dissolve a substantial proportion of said constituents without appreciable ferrite grain growth and then air cooling said steel to substantially room temperature so as to reduce the yield strength to about 55 ksi or less and improve formability of said steel while maintaining the ultimate strength thereof;

plastically deforming said steel an amount equivalent to at least 2% strain on the tensile stress-strain diagram to effect a substantial increase in the yield strength after said deformation, and aging said deformed steel by the equivalent of heating said deformed steel to a temperature of 400° F. for at least 5 minutes to increase the yield strength and tensile strength to values greater than their original values.

6. The method of producing a high strength low alloy steel having improved formability comprising the steps of:

cold rolling a hot rolled high strength low alloy steel having alloy constituents taken from the group consisting of the carbide, nitride and carbonitride of vanadium to a thickness of less than 0.075 inch, heating said cold rolled steel to the lowermost eutectoid temperature of said steel for a time sufficient to at least partially transform the microstructure of said steel from ferrite to austenite and to dissolve a substantial proportion of said constituents into the austenite without appreciable ferrite grain growth and then air cooling said steel to substantially room temperature so as to reduce the yield strength to about 55 ksi or less and improve formability of said steel while maintaining the tensile strength thereof; and plastically deforming said steel an amount equivalent to at least 2% strain on the tensile stress-strain diagram to effect a substantial increase in the yield strength after said deformation.

7. The method of producing a high strength low alloy steel having improved formability comprising the steps of:

cold rolling a hot rolled high strength low alloy steel having alloy constituents taken from the group consisting of the carbides, nitrides and carbonitrides of the metals taken from the group consisting of V, Ti, and Nb to a thickness of less than 0.075 inch, heating said cold rolled steel to at least the lowermost eutectoid temperature of said steel for a time sufficient to at least partially transform the microstructure of said steel from ferrite to austenite and to dissolve a substantial proportion of said constituents into the austenite without appreciable ferrite grain growth and then air cooling said steel to substantially room temperatures to substantially lower the yield strength and improve the formability of said steel while maintaining the tensile strength thereof;

plastically deforming said steel an amount equivalent to at least 2% strain on the tensile stress-strain diagram to effect a substantial increase in the yield strength after said deformation.

8. The method of producing a high strength low alloy steel having improved formability comprising the steps of:

cold rolling a hot rolled high strength low alloy steel having alloy constituents taken from the group consisting of the carbide, nitride and carbonitride of vanadium to a thickness of less than 0.075 inch, heating said cold rolled steel to the lowermost eutectoid temperature of said steel for a time sufficient to at least partially transform the microstructure of said steel from ferrite to austenite and to dissolve a substantial proportion of said constituents into the austenite without appreciable ferrite grain growth and then air cooling said steel to substantially room temperature so as to reduce the yield strength to about 55 ksi or less and improve formability of said steel while maintaining the tensile strength thereof;

plastically deforming said steel an amount equivalent to at least 2% on the tensile stress-strain diagram to effect a substantial increase to the yield strength after said deformation, and heating said deformed steel to a temperature and for a time sufficient to increase the yield strength and tensile strength to values greater than their original values.

9. The method of producing an SAE 980X high strength low alloy steel having improved formability comprising the steps of:

heating an SAE 980X high strength low alloy steel having alloy constituents taken from the group consisting of the carbides, nitrides and carbonitrides of the metals taken from the group consisting of V, Ti, and Nb to at least the lowermost eutectoid temperature of said steel for a time sufficient to at least partially transform the microstructure of said steel to austenite and to dissolve a substantial proportion of said constituents into the austenite without appreciable grain growth and then cooling said steel to substantially room temperatures so as to substantially lower the yield strength and improve the formability of said steel while maintaining the tensile strength thereof and plastically deforming said steel an amount equivalent to at least 2% strain on the tensile stress-strain diagram to effect a substantial increase in the yield strength after said deformation.

10. The method of producing an SAE 980X high strength low alloy steel having improved formability comprising the steps of:

heating an SAE 980X high strength low alloy steel having alloy constituents taken from the group consisting of the carbides, nitrides and carbonitrides of the metals taken from the group consisting of V, Ti, and Nb to at least the lowermost eutectoid temperature of said steel for a time sufficient to at least partially transform the microstructure of said steel from ferrite to austenite and to dissolve a substantial proportion of said constituents into the austenite without appreciable ferrite grain growth and then cooling said steel to substantially room temperatures so as to substantially lower the yield strength and improve the formability of said steel while maintaining the tensile strength thereof;

plastically deforming said steel an amount equivalent to at least 2% strain on the tensile stress-strain diagram to effect a substantial increase in the yield strength after said deformation, and heating said deformed steel to a temperature and for a time sufficient to increase the yield strength to a value in the vicinity of its original value.

* * * * *